US005518014A

United States Patent [19]

McEachen

[11] Patent Number: 5,518,014

[45] Date of Patent: May 21, 1996

[54] PORTABLE COUNTERTOP DISHWASHER

[76] Inventor: Peter C. McEachen, 2536 Overlook Rd. #402, Cleveland, Ohio 44106

[21] Appl. No.: 391,361

[22] Filed: Feb. 21, 1995

[51] Int. Cl.[6] ..... B08B 3/10

[52] U.S. Cl. ..... 134/107; 134/104.4; 134/115 G; 134/186

[58] Field of Search ..... 134/115 G, 186, 134/155, 104.4, 200, 107, 105, 108

[56] References Cited

U.S. PATENT DOCUMENTS

| | | | |
|---|---|---|---|
| 1,853,528 | 4/1932 | Zademach | 134/200 |
| 2,106,619 | 1/1938 | Merrill | 134/200 X |
| 2,168,770 | 8/1939 | Gunn, Jr. | 134/200 |
| 2,715,407 | 8/1955 | Wright | 134/200 |
| 2,824,567 | 2/1958 | Karlstrom | 134/57 D |
| 3,465,761 | 9/1969 | Meeker et al. | 134/58 D |
| 5,184,635 | 2/1993 | Tromblee et al. | 134/186 |

*Primary Examiner*—Frankie L. Stinson

[57] ABSTRACT

The portable countertop dishwasher of the invention employs a housing, such that the pump and fluid handling assembly of the structure is positioned within the dishwasher in a compact manner between the dishwasher floor and bottom wall, with a drying assembly directed into the rear wall of the dishwasher in operative communication with the dishwasher cavity.

7 Claims, 4 Drawing Sheets

PORTABLE COUNTERTOP DISHWASHER

TECHNICAL FIELD

The field of invention relates to portable dishwasher structure, and more particularly to a portable countertop dishwasher arranged for ease of transport and orientation relative to table tops and the like for ease of use in a temporary positioning of the dishwasher structure of the invention.

BACKGROUND OF THE INVENTION

Prior art dishwashers of various types have been indicated in the prior art as exemplified by the U.S. Pat. Nos. 3,460,878; 3,469,586; 3,710,819; 4,296,768; 4,535,795; and 4,542,756.

The instant invention is set forth to distinguish over the prior art by providing for a compact dishwasher structure, wherein the pump and drive motor structure of the invention is oriented within the dishwasher between the floor and bottom wall of the dishwasher arranged for ease of operative association to a conventional sink and faucet structure.

SUMMARY OF THE INVENTION

The portable countertop dishwasher of the invention employs a housing, such that the pump and fluid handling assembly of the structure is positioned within the dishwasher in a compact manner between the dishwasher floor and bottom wall, with a drying assembly directed into the rear wall of the dishwasher in operative communication with the dishwasher cavity.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figures 1, 2, 3:
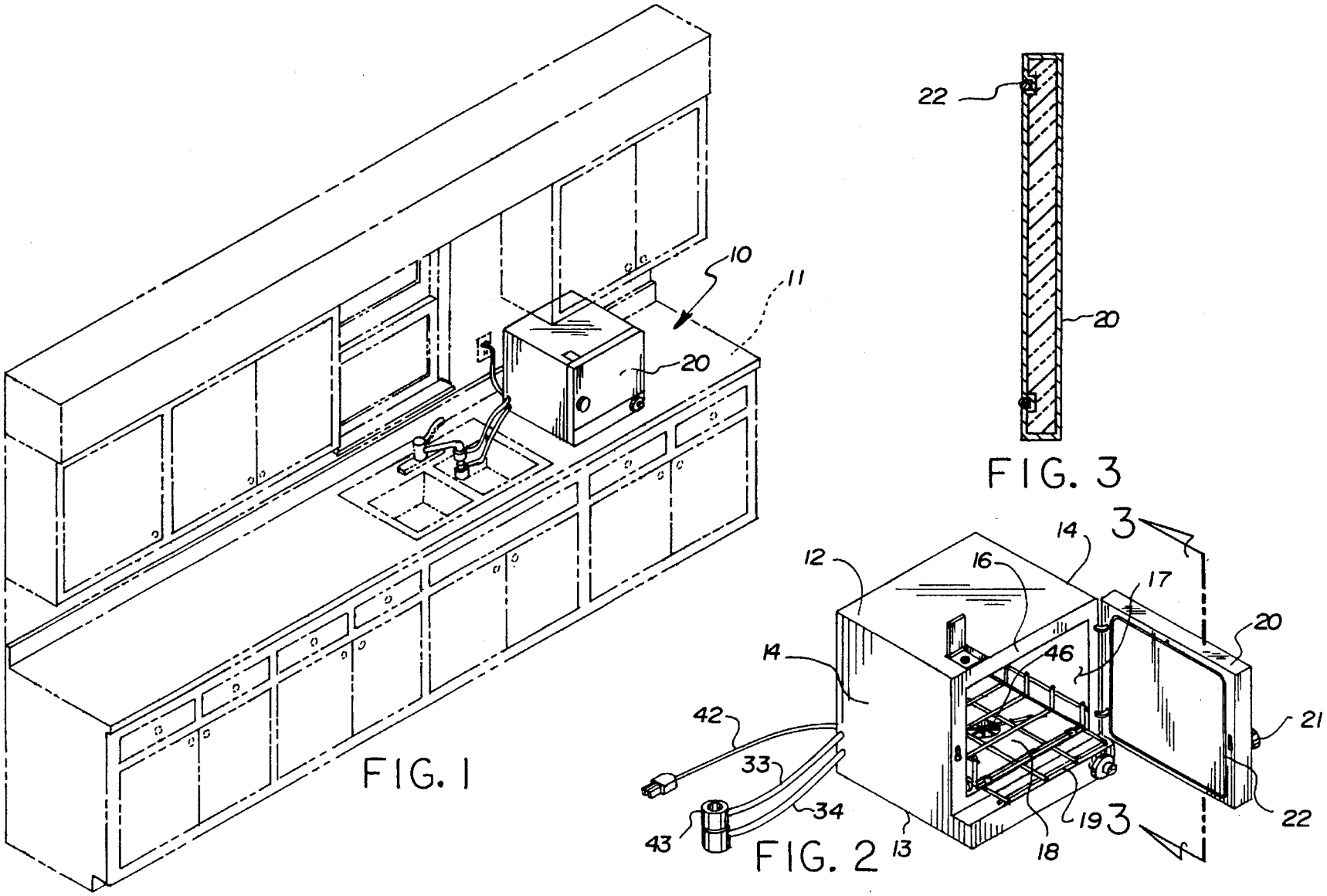
FIG. 1 is a perspective illustration of the invention positioned onto a conventional countertop structure.
FIG. 2 is a perspective illustration of the invention indicating the door opened relative to the dishwasher.
FIG. 3 is a cross-sectional illustration, taken along the lines 3—3 of FIG. 2.

The portable countertop dishwasher 10 of the invention is arranged for positioning onto a countertop 11, such as indicated in FIG. 1, adjacent a wet sink having a faucet and drain structure per se known in the prior art. To this end, the dishwasher housing is defined with a housing top wall 12 spaced from a housing bottom wall 13, spaced housing side walls 14, with a housing rear wall 15 spaced from a housing front wall 16, having a door 20 hingedly mounted relative to the front wall 16, such that the door includes a door latch 21 as well as a sealing ring 22 of continuous configuration arranged to engage the front wall 16 in a sealing relationship. Opening of the door 20 provides access to the housing cavity 17, such that the housing cavity 17 includes a floor 18 oriented and spaced from the housing bottom wall 13 to receive and have positioned therewithin a fluid handling assembly 23 of a type such as indicated in FIG. 4.

The dishwasher housing further includes the use of the door 20, as indicated in the FIGS. 1 and 2, and as illustrated hingedly mounted to one of the side walls 14, such that the door having a door latch 21 for securing the door to a recessed portion of the front wall 16 further includes a sealing ring 22 to engage the recessed portion of the front wall to provide for fluid impermeable sealing of the housing cavity 17 when the door is secured to the recessed portion of the front wall by the latch 21.

Figure 4:
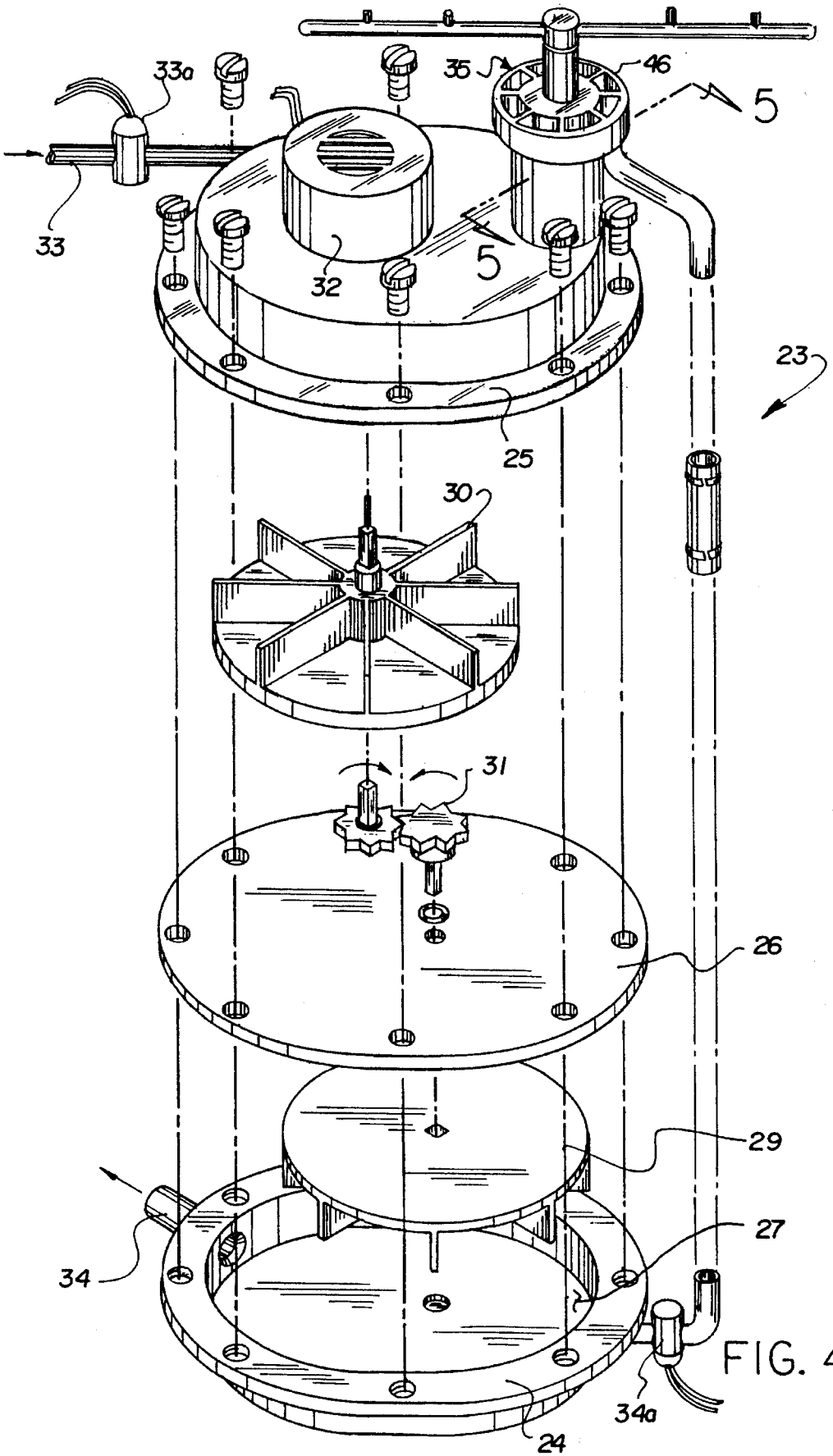
FIG. 4 is an exploded perspective illustration of the fluid handling structure of the invention.
Figure 5:
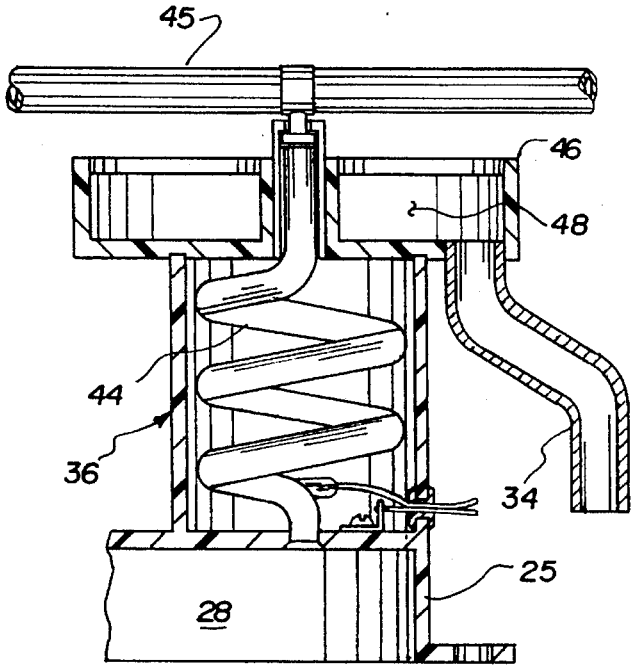
FIG. 5 is an enlarged cross-sectional illustration, taken along the lines 5—5 as indicated in FIG. 4.
Figure 6:
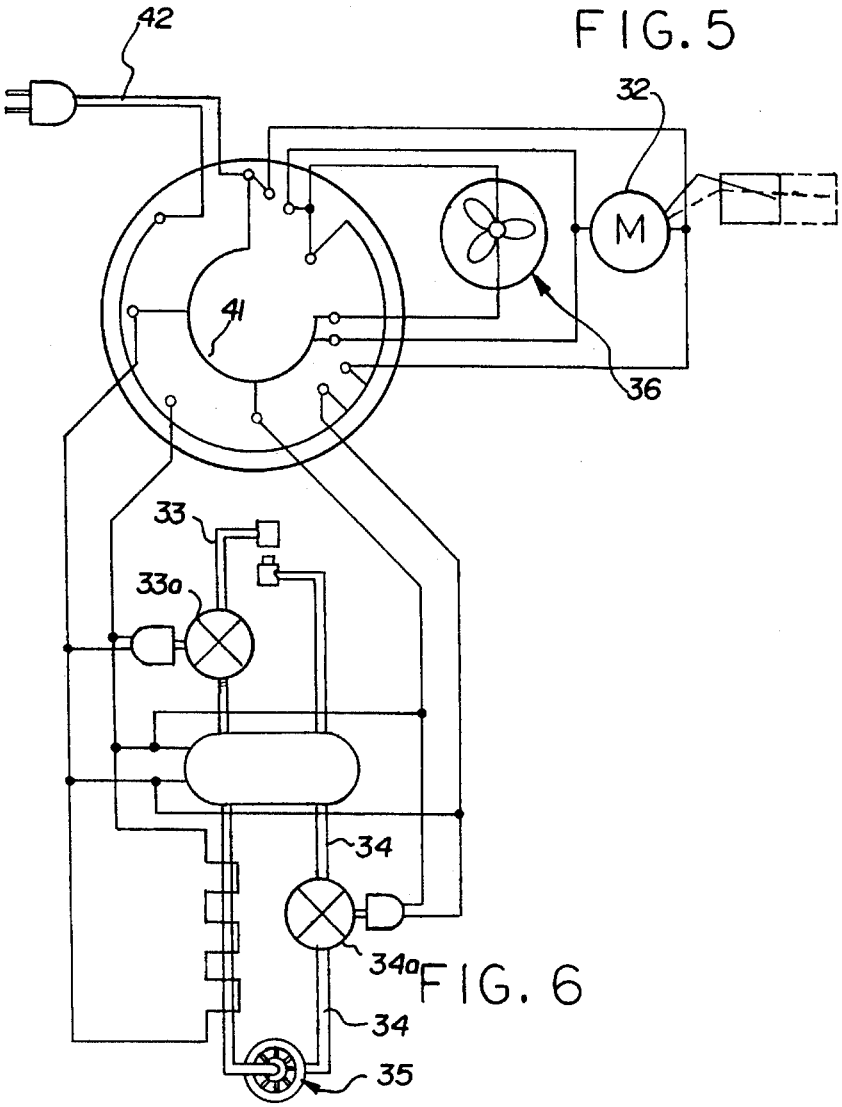
FIG. 6 is a schematic diagrammatic illustration of the various major components of the invention.

The fluid handling assembly 22 includes a lower pump housing 24 of a generally mirror image relationship to an upper pump housing 25 having an intermediate plate 26 to fluidly separate an upper pump cavity 28 relative to a lower pump cavity 27, as indicated in the FIGS. 4 and 5. The lower pump cavity 27 rotatably mounts a lower drive vane assembly 29 rotatable relative to and with an upper drive vane assembly 30 positioned within the respective lower and upper pump cavities 27 and 28. Intermediate gears 31 simultaneously drive the lower and upper drive vane assemblies 29 and 30. A drive motor 32 is mounted onto the upper pump housing 25 to effect driving of a drive shaft directed into the upper drive vane assembly 30 cooperative through the intermediate gears 31 that includes an intermediate gear shaft received within the lower drive vane assembly 29 to effect simultaneous rotation by the motor 32. An inlet conduit 33 is directed into the upper pump housing 25, while an outlet conduit 34 is directed from the upper pump housing, as well as communicating the upper pump cavity 28 to the lower pump cavity 27, such that an outlet conduit solenoid valve 34a secured to the outlet conduit between the upper pump housing and the lower pump housing effects selective fluid communication therebetween, with an inlet conduit solenoid valve 33*a* secured operatively to the inlet conduit 33 to effect selective fluid flow through the inlet conduit 33 to the upper pump housing 25 and the associated upper pump cavity 28. A fluid distribution housing 35 in fluid communication with the upper pump cavity 28 includes a delivery conduit 44 in fluid communication with the upper pump cavity 28 directed to a rotatable distribution manifold 45 having its outlet nozzles angularly oriented to effect rotation of the manifold. The fluid distribution housing 35 includes an apertured top wall 46 at least coplanar with or recessed below the housing cavity floor 18, such as indicated in FIG. 2, to permit fluid flow into an upper chamber 48 of the fluid distribution housing 35 permitting projection of fluid therefrom through the outlet conduit 34 when the outlet conduit solenoid valve 34*a* is energized.

It should be noted that a power supply 42, as well as the inlet and outlet conduits 33 and 34 respectively that project from dishwasher housing are preferably retractably mounted relative to the housing for convenience of transport and storage of the unit. It should also be noted that the inlet conduit 33 includes a resilient cup member 43 to engage the faucet structure, such as indicated in FIG. 1, to direct washing water into the dishwasher housing, and more specifically the fluid handling assembly 23.

As illustrated, the control dial 41 projects through the front wall but may be directed through any of the walls for convenience and as illustrated in the FIGS. 1 and 3, a washing soap door is opened relative to the top wall 12 to direct dishwasher type fluids and granules into the dishwasher unit 10 as a convenient access to the dishwasher housing.

Figure 7:
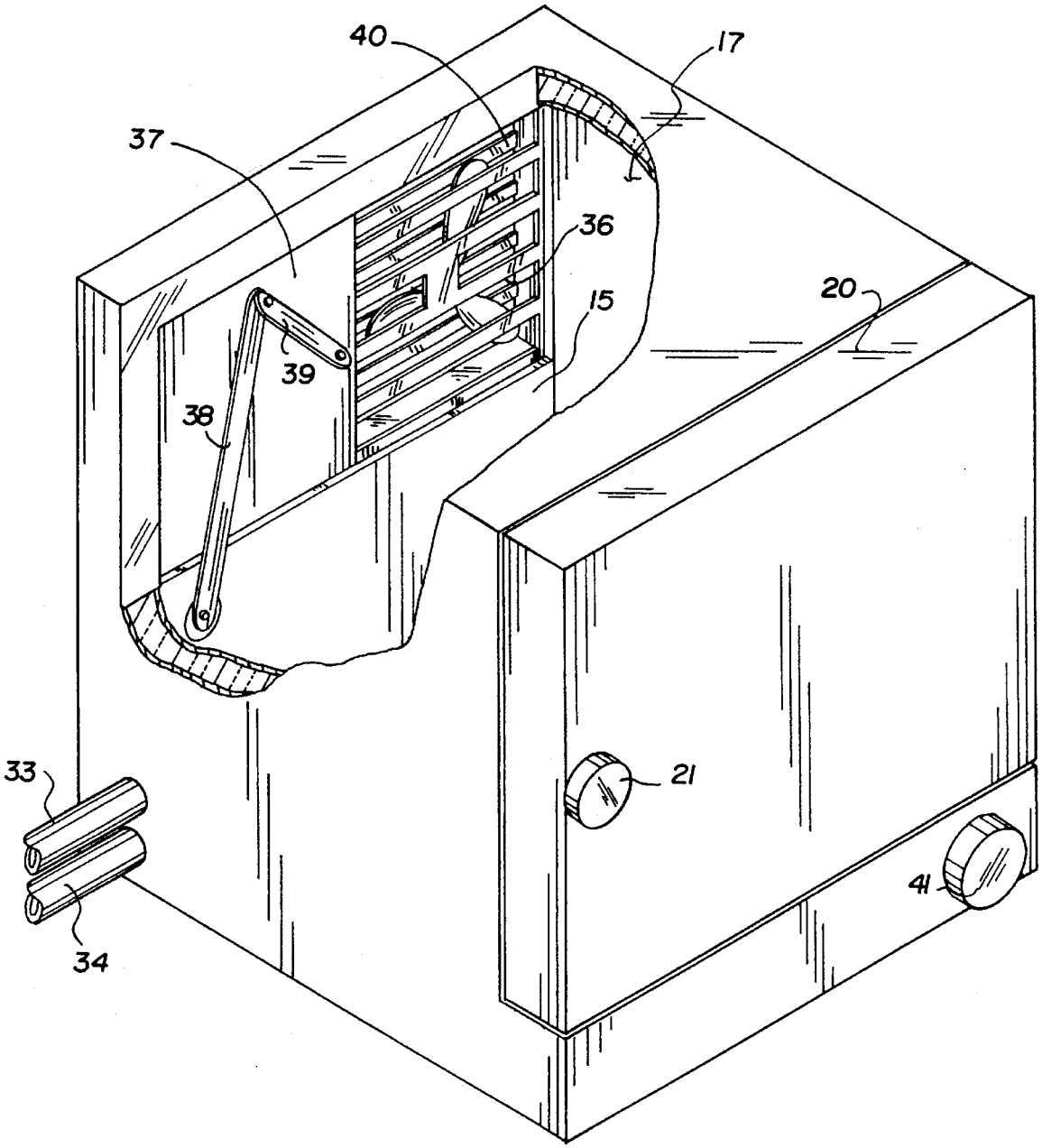
FIG. 7 is an enlarged perspective illustration, partially in section, indicating the dryer assembly within the dishwasher structure.

It should also be noted, such as illustrated in the FIG. 7, that the heating grid 40, such as illustrated in FIG. 7, is mounted within the housing rear wall 15, with a drive fan of the heating assembly 36 arranged to direct heated air into the cavity 17 employing suitable venting and the like through the housing rear wall, as required. The heating structure employs a door plate 37 slidably mounted within the housing rear wall within the cavity facing the cavity to expose selectively the heating assembly and to this end, a first link 38 pivotally mounted at one of its ends to the housing rear wall below the door plate 37 has the first link 30 pivotally mounted at its other end to a second link 39 that in turn is pivotally mounted to the door, such that pivoting of the first link effects displacement and positioning of the door plate to expose the heating grid subsequent to a washing scenario, with the door plate 37 oriented for manual displacement to this end, but alternatively may employ as necessary a mechanical inner link as may be provided.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A portable countertop dishwasher, comprising, a dishwasher housing, having a housing top wall spaced from a housing bottom wall, spaced housing side walls, a housing rear wall, and a housing front wall, and a housing cavity oriented within the housing, and the housing further having a cavity floor spaced from the housing bottom wall, and a support rack within the cavity is reciprocatably mounted relative to the cavity, and a fluid handling assembly positioned within the housing between the housing floor and the housing bottom wall, and an inlet conduit directed into the fluid handling assembly, and an outlet conduit directed into the fluid handling assembly, wherein the outlet conduit and the inlet conduit project from the housing;

the fluid handling assembly includes a lower pump housing secured relative to an upper pump housing, with an intermediate plate between the lower pump housing and the upper pump housing, with the intermediate plate defining a lower pump cavity within the lower pump housing, and an upper pump cavity within the upper pump housing, the lower pump housing having a lower drive member to direct fluid through the outlet conduit, and the upper pump cavity having an upper drive member projecting fluid through the inlet conduit.

2. A dishwasher as set forth in claim 1 wherein the inlet conduit includes a resilient cup at a free distal end of the inlet conduit arranged for securement to a water supply conduit.

3. A dishwasher as set forth in claim 1 wherein the upper pump housing has in fluid communication therewith a fluid distribution housing, and the fluid distribution housing including a delivery conduit in fluid communication with the upper pump cavity, and the delivery conduit directed through an upper chamber within the fluid distribution housing, and a rotatable distribution manifold rotatably mounted about the fluid distribution housing, the fluid distribution housing including an apertured top wall, with the apertured top wall positioned within the housing floor.

4. A dishwasher as set forth in claim 3 further including heater means within the dishwasher housing, the heater means positioned within the housing rear wall.

5. A dishwasher as set forth in claim 4 wherein the heater means includes a heating grid and a fan in operative communication with the heating grid to direct fluid within the housing cavity, and a slidable door plate slidably mounted within the cavity to extend over the heating means arranged to selectively isolate the heating means relative to the housing cavity.

6. A portable countertop dishwasher, comprising, a dishwasher housing, having a housing top wall spaced from a housing bottom wall, spaced housing side walls, a housing rear wall, and a housing front wall, and a housing cavity oriented within the housing, and the housing further having a cavity floor spaced from the housing bottom wall, and a support rack within the cavity is reciprocatably mounted relative to the cavity, and a fluid handling assembly positioned within the housing between the housing floor and the housing bottom wall, and an inlet conduit directed into the fluid handling assembly, and an outlet conduit directed into the fluid handling assembly, wherein the outlet conduit and the inlet conduit project from the housing;

heater means within the dishwasher housing, the heater means includes a heating grid and a fan in operative communication with the heating grid to direct fluid within the housing cavity, and a slidable door plate slidably mounted within the cavity to extend over the heating means arranged to selectively isolate the heating means relative to the housing cavity.

7. A dishwasher as set forth in claim 6 wherein the door plate having a first link pivotally mounted within the cavity at a first link first end, and a first link second end having a second link pivotally mounted thereto, the second link pivotally mounted to the door plate spaced from the first link, whereupon pivoting of the first link displaces the door plate permitting selective exposure of the heating grid.

* * * * *